United States Patent [19]

Lent

[11] 4,284,983

[45] Aug. 18, 1981

[54] APPLIANCE ANTI-THEFT AND PROTECTION CIRCUITRY

[76] Inventor: Roger S. Lent, Rte. 2, Box 438, Candler, N.C. 28715

[21] Appl. No.: 122,571

[22] Filed: Feb. 19, 1980

[51] Int. Cl.[3] ..... G08B 13/14

[52] U.S. Cl. ..... 340/568; 340/571; 340/652; 340/687

[58] Field of Search ..... 340/568, 571, 572, 635, 340/636, 652, 687

[56] References Cited

U.S. PATENT DOCUMENTS

| | | | |
|---|---|---|---|
| 3,484,775 | 12/1969 | Cline | 340/568 |
| 3,710,371 | 1/1973 | Whalen et al. | 340/571 |
| 3,766,540 | 10/1973 | Schapfer et al. . | |
| 3,794,989 | 2/1974 | Manley et al. | 340/524 |
| 3,836,901 | 9/1974 | Matto et al. | 340/571 |

*Primary Examiner*—Alvin H. Waring
*Attorney, Agent, or Firm*—Pitts & Kesterson

[57] ABSTRACT

New and unique circuitry suitable for being located in electrical appliances, and which protects such appliances from theft and unauthorized movement. More particularly, the invention discloses circuitry for providing an alarm when the appliance is both disconnected and moved. The circuitry monitors both power input and movement of the appliance, and provides a pulsating signal suitable for sounding and audible alarm until the appliance is either reconnected or the alarm interrupted by a key switch. According to one particular embodiment, a mercury interrupter is uniquely arranged to operate as both the motion sensor and the oscillator for providing pulsating power to the audible alarm.

11 Claims, 12 Drawing Figures

APPLIANCE ANTI-THEFT AND PROTECTION CIRCUITRY

BACKGROUND OF THE INVENTION

This invention relates to protection and anti-theft devices, and more particularly to anti-theft devices for use with appliances such as TV's and the like located in motels and other areas subject to an unusually high percentage of theft. More particularly, the apparatus of this invention is suitable for detecting when an appliance is both disconnected from its primary power source and subsequently moved.

Various types of circuitry and devices are already available and used for detecting theft of certain appliances and for providing alarms. These circuits are particularly useful and find their primary use in motels, hotels and the like for protecting expensive small items such as TV sets, radios, etc. The previous type of protection devices are of various types. Some of these prior art devices operate whenever the appliance or set is moved from a predetermined location whereas others operate whenever the appliance is disconnected from its electrical power source. Still others combine these techniques, and only sound the alarm when the appliance is both disconnected and moved from its predetermined location. However, as is discussed hereinafter each of these prior art devices is typically either unusually complex or expensive. For example, U.S. Pat. No. 3,484,775 issued to W. D. Cline on Dec. 16, 1969, discloses circuitry which is connected between a standard wall receptacle for a TV set or other electrical appliance and the power cord of the appliance itself. A provision is made so that the alarm box connected to the wall is not easily unplugged. However, when the appliance plug itself is removed from the alarm box the alarm is given. In operation, removal of the appliance plug from the alarm box closes a switch which activates an RF transmitter circuitry which uses the electrical power wiring of the motel or hotel itself to transmit a signal to a receiver at a central monitoring location such that an alarm may be sounded. However, as will be appreciated from a study of the device of this patent, all that needs to be done to defeat the protection offered by this device is to forceably remove the alarm box from the electrical power outlet itself prior to removing the plug of the appliance from the box. It will further be appreciated that a thief in the process of stealing such an appliance will not be concerned about causing damage to the wall or the electrical power system of the motel by forceably removing the alarm box. Thus, although the described device might be effective against the novice thief, it in no way would deter the professional thief.

Still another protective device is disclosed in U.S. Pat. No. 3,710,371 issued to Whalen et al on Jan. 9, 1973. According to this patent, the alarm device uses a sensitive triggering device which when displaced from a normal position an audible alarm is latched closed and cannot be silenced unless a correct procedure or key method is followed. Typically, such a device will be located on the interior of a TV set and uses a mercury switch to trigger the alarm. Although very sensitive, and not easily observed or defeated, this type device has its objectionable characteristics in the fact that the alarm may inadvertently be set off when no theft was intended. For example, an innocent occupant of a motel or hotel may either jar the TV set or simply be wanting to move it slightly from one position to another and set off the alarm. The embarrassment and subsequent anger of a motel or hotel occupant innocently setting off the alarm is readily apparent.

Still another complex protection system disclosed in U.S. Pat. No. 3,766,540 issued to Schapfer et al on Oct. 16, 1973, and having some similarity to the detection system of the Cline patent is available for large motel and hotel operations. According to this circuitry, each of the appliance or TV's to be protected require modification of the TV or appliance by connecting a quartz crystal oscillator across its terminals. A frequency modulated oscillator connected to a transmission line which connects all the appliances is employed to stimulate the crystals in sequence. A transmission receiver which operates at a selected frequency and phase keeps track of the operating crystals. An alarm or a visual display of a number indicates the time and place of removal of the appliance. The obvious disadvantage of this system is the required modification and the complexity of the transmission and monitoring.

Still another type circuitry which combines the advantages of the Whalen and the Cline circuitry is available in circuitry disclosed in U.S. Pat. No. 3,836,901 issued to Matto et al on Sept. 17, 1974. According to this patent, the circuitry is mounted entirely or partly within the device to be protected and includes and alarm circuit loop and a control loop. The control loop continuously determines whether or not the line cord of the appliance is connected to the wall socket. The control loop further determines if the appliance is being moved. Only when an appliance is both moved and disconnected from the alarm circuit is the alarm of this particular circuitry activated. According to the circuitry described in this patent, a reed switch is held open to deactivate the alarm circuitry whenever the appliance is connected to the wall plug. However, although the device described in the Matto et al patent is superior to the device described heretofore, it still requires the use of discrete and expensive components which are subject to short life.

In addition to the Matto et al, the Whalen et al, the Schopfer et al, and the Cline patents, an investigation of the prior art revealed several other patents related to the present invention. These patents include U.S. Pat. No. 3,045,226 issued to W. B. Trayner on July 17, 1962; U.S. Pat. No. 3,644,921 issued Duggan et al on Feb. 22, 1972; U.S. Pat. No. 3,794,989 issued to Manley et al on Feb. 26, 1974; U.S. Pat. No. 4,023,157 issued to Miller on May 10, 1977, and U.S. Pat. No. 4,121,201 issued to Weathers on Oct. 17, 1978. A review of these patents, quickly discloses that a great deal of effort and concern has been put into arriving at anti-theft devices for protecting TV sets and the like located in hotel and motel rooms. To date as mentioned above, all of the previous devices include certain objectionable characteristics.

SUMMARY

Accordingly, it is an object of the present invention to provide an inexpensive and easily maintained protection circuitry which cannot be readily set off by the activities of an innocent party.

It is a further object of this invention to provide a theft protection device for protecting appliances, which cannot readily be silenced without reconnecting the appliance to its wall plug.

It is still another object of this invention to provide theft detection circuitry which is activated only when an appliance is removed from its wall plug and moved from its predetermined location.

It is still another object of this invention to provide a theft protection circuit which can be rendered inoperable by an authorized person.

It is yet another object of the present invention to provide an anti-theft device which is located with the appliance being protected and will continue to sound an audible alarm from the stolen device as the device is moved.

The above objects, as well as others, are accomplished according to the present invention by providing theft detection and prevention circuitry for use with appliances connected to a primary electrical power source; such as for example, an AC house power source. The circuitry comprises a rechargeable electrical power source such as for example, a capacitive source or a battery source. Also included is charging circuitry for converting power from the primary or AC electrical power source to suitable DC power for recharging the rechargeable electrical power source. Also included is an oscillation means connected to the rechargeable power source which provides a pulsating signal which can be used to provide a pulsating signal to an alarm, and which serves as a latching circuitry. This oscillation and latching circuitry then in turn controls circuitry such as for example, a Silicon Controlled Rectifier (SCR) or power transistor connected between the alarm means and the power source such that the pulsating signal from the oscillator provides a pulsating signal to the alarm. A motion sensor located in the circuitry determines when the sensor or the appliance to which the sensor is connected is moved from a predetermined position and location. A monitoring means continuously monitors whether or not the appliance is connected to the standard or AC power source, by determining whether or not suitable DC power is available for charging the rechargeable power source. The oscillation system is rendered inoperative by the monitoring means except when power is not available for recharging the rechargeable power source. Thus, the oscillation circuit is activated which in turn operates the switching means when the appliance is disconnected from the wall plug and is subsequently moved from its predetermined position. In a particular embodiment of this invention, a mercury interrupter operates as a combination oscillation means and motion sensor. Thus, according to this particular embodiment, an unusually inexpensive and effective monitoring device and anti-theft device is provided.

DESCRIPTION OF THE INVENTION

Figure 1:
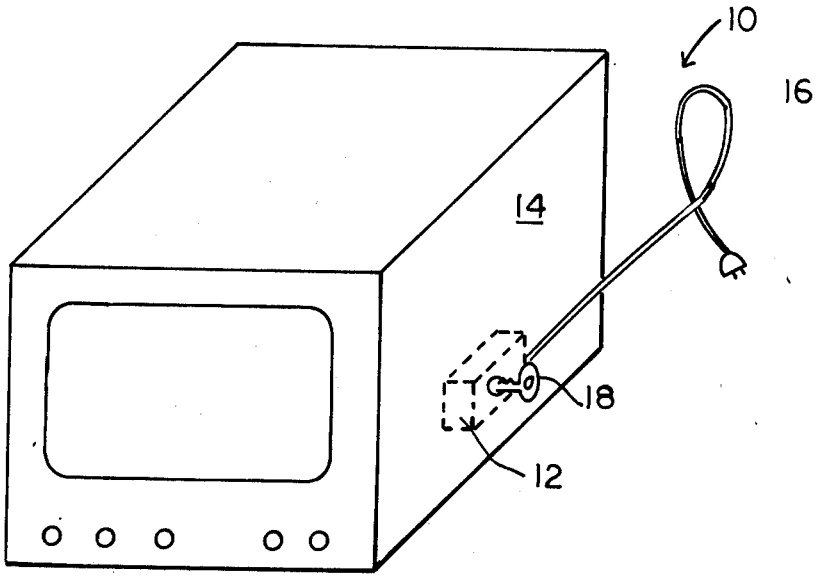
FIG. 1 is a perspective view of the anti-theft device of this invention incorporated in a TV set.

Referring now to FIG. 1, there is shown generally at 10 a typical use of the anti-theft device 12 of the present invention mounted in a typical TV set 14. As can be seen, the standard power cord 16 is routed to the TV set and through the anti-theft device 12 located in the interior of the TV set. A key switch 18 allows authorized personnel to inhibit the anti-theft circuitry for authorized movement of the TV set.

Figure 2:
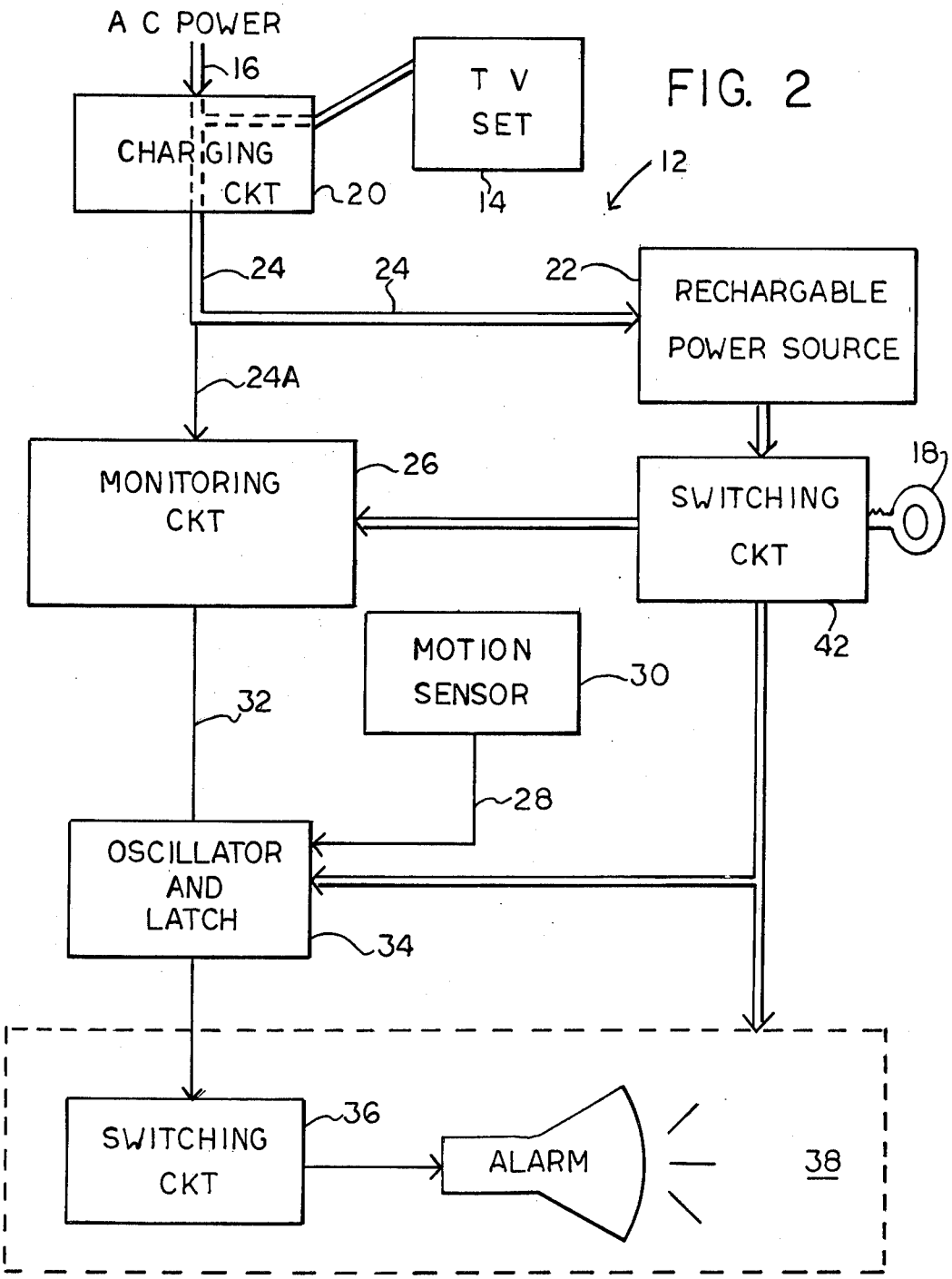
FIG. 2 is a block diagram of a first embodiment of the anti-theft device of this invention.

Referring now to FIG. 2, there is shown a block diagram of a first embodiment of the present invention. As will become clear in the following discussion, double lines connecting the various components represented by boxes, represents power flow whereas a single connecting line represents a monitor or control signal. As shown, AC power such as for example, standard house 110 volt AC power is received on line 16 by charging circuit 20. Charging circuit 20 can be any suitable type charging circuit which converts standard AC, 60 cycle 110 volt power to a DC voltage level suitable for recharging a rechargeable power source 22 such as for example, batteries or a capacitive power source. It will be appreciated that in the embodiment shown in FIG. 2 the charging circuit serves to provide a DC trickle charge to the battery from the AC power source and will typically consist of a transformer, along with capacitors, resistors and a full wave or half wave rectifier. It is also possible to use commercially available integrated charging circuits if desired. It will further be appreciated, however, that for some uses, AC power will not be available, and DC power would be used as the primary power source provided to charging circuit 20. For example, if the device is to be used in an automobile, then the primary power source would be the basic 12 volt power provided by the automobile electrical system. In such an instance, of course, transformers and half or full way rectifiers would not be necessary. The output on power line 24 to rechargeable power source 22 thus provides recharging power of a proper DC voltage level to recharge the rechargeable power source 22. Rechargeable power source 22 it will be appreciated, may be any suitable battery pack or capacitive power pack. It will further be appreciated that rechargeable power source 22, need not have a substantial amount of reserve power, and the amount of total power availabe should be determined upon the desired length of an audible alarm signal, which as will be discussed hereinafter, will receive its power from rechargeable power pack 22. As is shown, monitor line 24A provides an indication to monitoring circuitry 26 which continuously monitors the availability of recharging power to rechargeable power source 22. Although the circuit and schematic details of monitoring circuit 26 will be discussed hereinafter, it will be appreciated that in the disclosed embodiments, monitoring circuit 26 is used as a means of inhibiting alarm circuitry when the battery is being charged, and as will become clear as long as the appliance is connected to the standard AC power source, monitoring circuit 26 will monitor the fact that recharging power is available on line 24 for recharging power source 22 and thus the alarm circuitry will be inhibited. Although the details of various monitoring circuits will be discussed hereinafter with respect to the detailed schematics of this invention, it will be appreciated that any suitable monitoring device may also be used. For example, the monitoring circuit may consist of a rectifier, transistor switch, and/or filter or simply a relay which passes power from the charging circuit when the device is connected to the primary AC g power source, but it will not pass power from the battery when the battery is not being charged. Referring again to FIG. 2, it can be seen that in addition to the monitoring signal received on line 24A, oscillation circuitry 34 receives a motion sensor signal on line 28. As will be discussed hereinafter, any suitable motion sensor may be selected, and it will be appreciated that the motion sensor is a means for providing an indication that the TV set has been relocated, tilted or otherwise moved in a manner which is unauthorized. Motion sensor 30 may consist of one or more mercury switches mounted in different directions to indicate motion. The sensor could also consist of a plurality of microswitches located around the outside of a concave disc which may be activated by a heavy metal sphere. Alternately, it could be a contactor wherein a heavy metal sphere is free to roll and thus provide contact when the TV set is moved. There may simply be a suspended magnetic pendulum which is used to activate one or more reed switches, or hall effect devices, or the pendulum may simply contact microswitches or a ring contactor surrounding the shaft of the pendulum. In addition, an electro-magnetic pickup coil, etc. could be used. In any event, motion sensor 30 is for the purpose of simply providing a signal to monitoring circuit 26 whenever physical motion of the TV set or other appliance being protected is moved, tilted, or otherwise relocated in an unauthorized fashion. As will become clear hereinafter, monitoring circuit 26 will control, by means of line 32, self-latching oscillator 34 such that oscillator 34 is in an operating mode only if monitoring circuit 26 has determined that no power is available on line 24A to rechargeable power source 22, and at the same time that a signal is present on line 28 from motion sensor 30 indicating that the TV set or appliance is in the process of being moved. In the embodiment shown, the signal on line 28 activates oscillator 34, which triggers switching circuit 36, contained in switching alarm combination circuitry 38 thereby providing a pulsating signal to alarm 40. Thus, it will be appreciated that the alarm will operate by disconnecting the appliance being protected and then moving the appliance after it is disconnected.

It will be appreciated, of course, that it will not be unusual that authorized removal or changing locations of the TV set or appliance is necessary. Therefore, as is shown, the present invention further includes a power switch 42 (which is typically a key switch) which is electrically located between the rechargeable power source 22 and each of the circuit components which require power for operation. Thus, when authorized movement of the appliance is desired, switch 42 is simply operated to disconnect power from any one or more of the various circuit components heretofore discussed which require power from power source 22 for operation. Once the appliance has been located to its new desired location, switch 42 is simply closed again, key 18, removed and the alarm and anti-theft circuit is back in operation.

Figure 3:
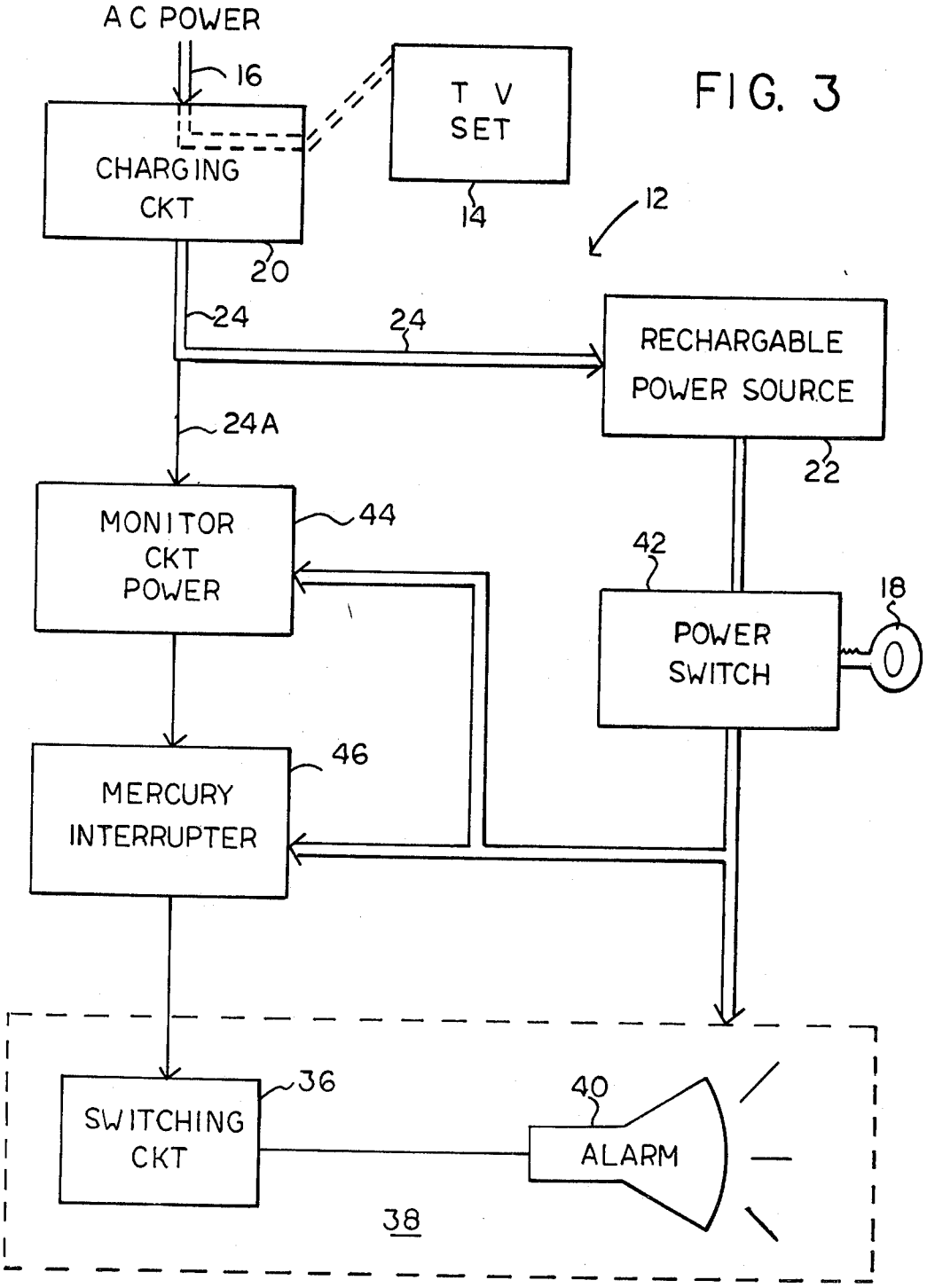
FIG. 3 is a block diagram of an alternate and preferred embodiment of the anti-theft device of this invention.

Referring now to FIG. 3, there is shown a preferred and simplified embodiment of the present invention. As shown in the block diagram of FIG. 3, standard power such as AC power is provided on line 16 to charging circuit 20 which will operate the same as discussed heretofore with respect to FIG. 2. In addition, the power is also shown as going to the TV set 14. The output of charging circuit 20 on power line 24 is also provided to rechargeable power source 22. Charging circuit 20 and rechargeable power source 22 operate the same and provide the same function as was discussed heretofore with respect to FIG. 2. In addition, line 24A also provides the indication to monitoring circuitry 44, that recharging power is available for recharging power source 22 in the same manner as was discussed heretofore. Thus, any time power is availabe for recharging power source 22, monitor circuitry 44 will inhibit the operation of mercury interrupter circuit 46 as will be discussed hereinafter.

Thus, any time recharging power is not available for recharging power source 22, mercury interrupter circuit 46 is in an operable condition. If at that time, the TV set or other appliance being protected by this circuitry of this invention, is moved, mercury interrupter circuitry 46, as will be discussed in detail hereinafter, also operates as a motion sensor such that if unauthorized motion of the TV set takes place, the motion will be sensed by mercury interrupter 46 and mercury interrupter 46 will then commence to oscillate such that a pulsating signal is provided to the combination switching and alarm circuit 38 with the result that a pulsating audible alarm is provided by alarm 40. As shown in FIG. 3, poweer switch 42 operates in the same manner as discussed heretofore with respect to FIG. 2 for selectively interrupting power to one or more of the various components of the invention.

Figure 4A:
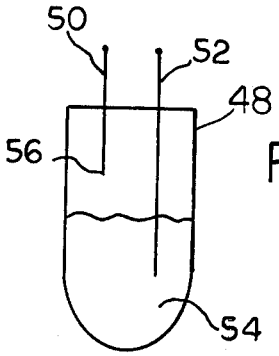
FIGS. 4A and 4B show typical motion sensor switches for use with the circuitry of the device shown in FIG. 2.
Figure 4B:
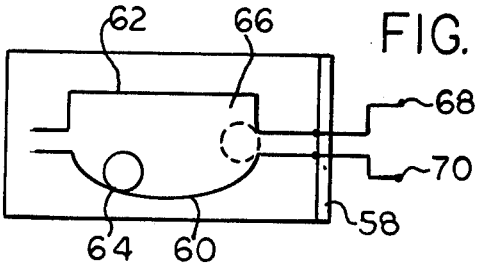

As was discussed heretofore, the motion sensor 30 as used in FIG. 2, may consist of any suitable design. Examples of such designs are illustrated in FIGS. 4A and 4B. As shown in FIG. 4A, there is a common type mercury switch. As will be appreciated by those skilled in the art, the mercury switch of FIG. 4A typically includes a glass envelope 48 through the wall of which are sealed two electrical leads 50 and 52. One of the leads extends into a pool of mercury 54 whereas the other lead has an end 56 which does not reach to the pool of mercury 54. As will be appreciated, however, that if container 48 is tilted, mercury 54 will contact end 56 of lead 50 to complete a circuit.

Referring now to FIG. 4B, there is shown still another type of motion sensor suitable for use with this invention. As is shown, the motion sensor generally indicated at 58 includes a shallow disc member 60 and a upper lid-like member 62. An electrically conducting metal ball, sphere or mercury glob 64 is located within the disc 60 such that it may roll around freely within said disc. If the sensor 58 is tilted or jarred enough such that the electrically contacting ball 64 rolls or is jarred to the position such as shown in the dotted line representation 66, contact is made between the metal saucer-shaped member 60 and the metal lid-like member 62. Electrical wires or conducting members 68 and 70 are connected respectively to lid member 62 and saucer member 60. Thus, it will be appreciated that a circuit can be completed between terminals 68 and 70.

Referring now to FIGS. 5A through 5D, there are shown four examples of a mercury interrupter, which figures will be discussed in detail hereinafter. However, prior to a detailed discussion of the four specific examples of mercury interrupters, a basic discussion of the mercury interrupter is hereby provided. In particular, the mercury interrupter includes a metallic container 72 to which is connected an electrical lead 74. Also contained in the container 72 is a non-conducting liquid 75. An insulating member 76 supports a flexible conducting rod 78 which in turn is connected to another electrical lead 80. At the end of conducting rod 78 is a glob of mercury 82. In other embodiments as will be discussed hereinafter, rather than a glob of mercury 82, the glob can be replaced with a metal conductive ball which is simply coated or wetted with mercury. Operation of the mercury interrupter works as follows. The interrupter is connected by leads 74 and 80 such that a power source (not shown) can provide power to a load (also not shown). When the mercury interrupter is vibrated or otherwise moved so that the mercury wetted ball 82 makes contact with the side or surface of the container 72, current flows in the small area of mercury which touches the surface of the container thereby causing local heating and resulting in expansion of the mercury so that the entire glob of mercury is propelled away from the container surface 72. The mercury glob 82 continues to swing away from the surface of the container 72 until it again is stopped by gravity, fluid resistance, etc. or by the surface of container 72 in the opposite direction. This process continues so long as a load current flows through the mercury interrupter. The insulating liquid 75 as shown, is optional, but serves to help cool the contact area faster and also to slow down the motion of the flexible rod carrying the mercury glob. However, since the liquid is optional, it may be dispensed within favor of an inert atmosphere or vacuum. In addition, as will be discussed hereinafter, the oscillation or duty cycle of the mercury interrupter can be somewhat controlled by the selection of the insulating liquid 75.

Figure 5A:
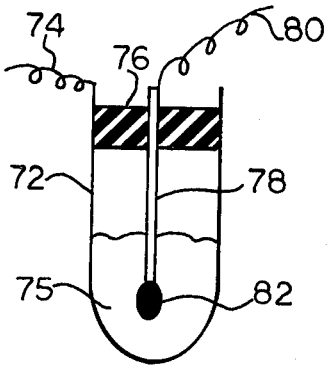
FIGS. 5A through 5D show typical arrangements of mercury interrupters suitable for use with the anti-theft device disclosed in the block diagram of FIG. 3 above.
Figure 5B:
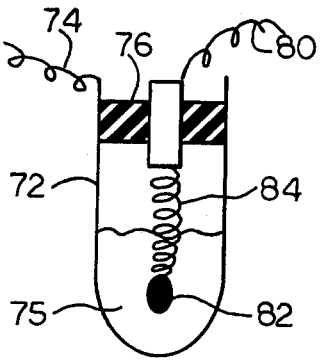
Figure 5D:
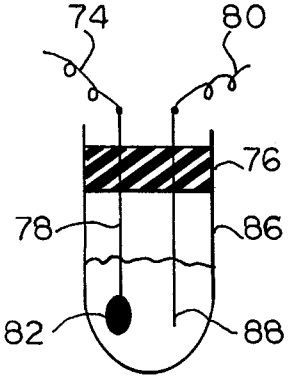
Figure 5C:
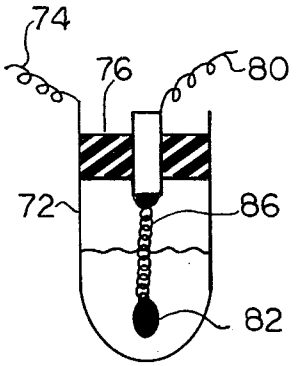

Referring now to FIGS. 5B through 5D, there are shown three other different types of mercury interrupters substantially similar to the one discussed. For example, FIG. 5B operates identical to that of FIG. 5A already discussed, except that flexible shaft member 78 has been replaced with a spring member 84. In a similar manner, the mercury interrupter of FIG. 5C also operates substantially the same, except that flexible shaft member 78 has been replaced with a conducting chain 86. There is also shown, at FIG. 5D, still another type of mercury interrupter. According to the embodiment of FIG. 5D, the interrupter is similar to that discussed with respect to 5A except instead of a conducting enclosure 72, there is a non-conducting enclosure 86. In addition, the conducting lead 80, rather than being connected to the container itself, is connected to a rod 88 which cannot be "wetted" by mercury. Operation of the device is similar to that discussed heretofore except, that the mercury glob or ball 82 contacts the non-mercury wetable rod 88 to complete the circuit.

As was mentioned briefly heretofore, the oscillation or duty cycle of the mercury interrupter can be controlled by various means including the viscosity of the insulating fluid 75, the size and weight of the mercury-wetted ball 82, the spring constant, and the diameter of the conductive enclosure 72. In addition, it should be appreciated that with any selected mercury interrupter, the oscillation will be substantially constant regardless of the amount of current flowing therethrough. Although this does not hold true for very large or very small currents it does hold true for the large range of currents that would be expected to pass through the interrupter. Thus, it will be appreciated that the oscillation or duty cycle of the interrupter may be controlled by proper selection of the type of interrupter. In addition, it will also be appreciated that the oscillation can be controlled by normal means such as external circuit components.

Figure 6:
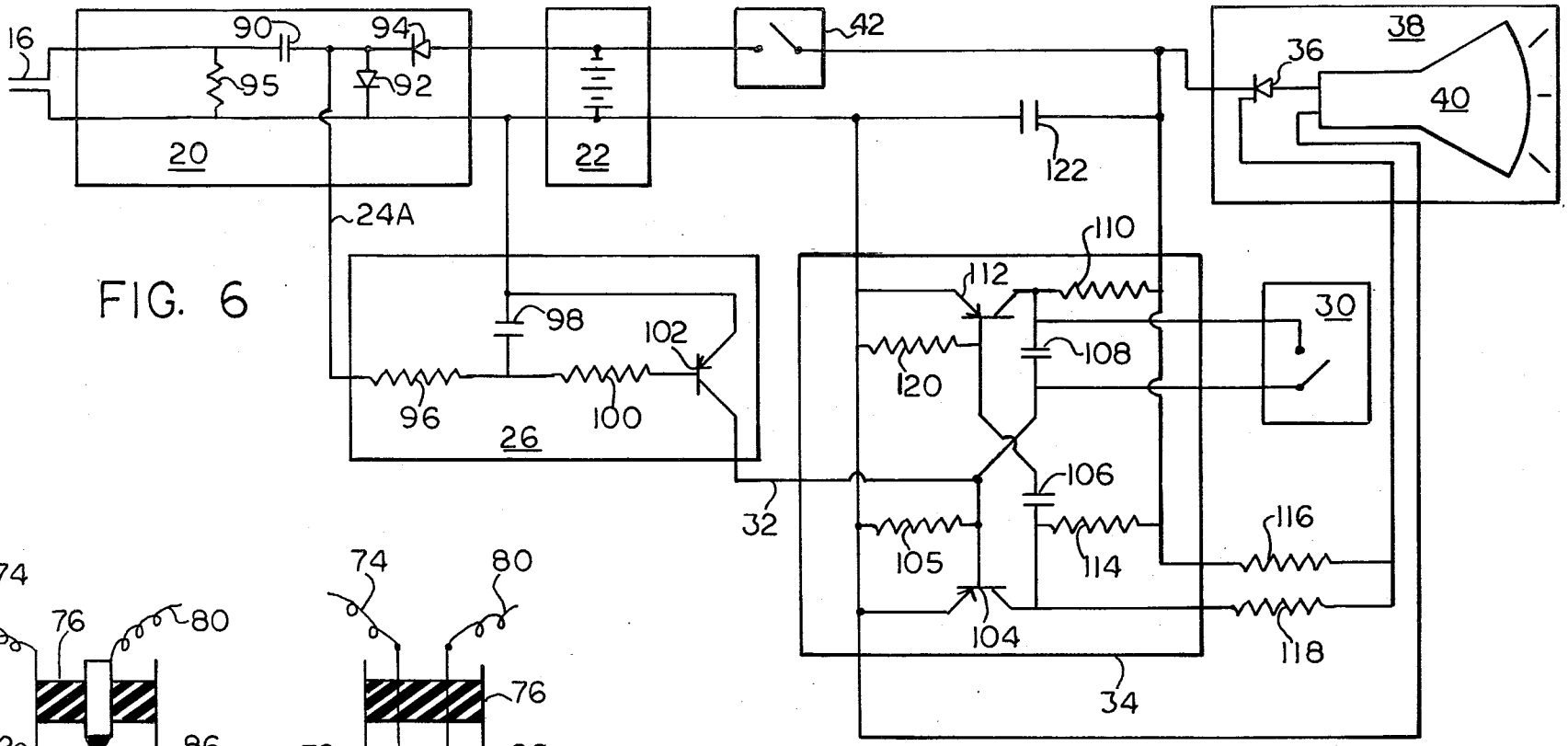
FIG. 6 shows an electrical schematic of the anti-theft device shown in the block diagram of FIG. 2 and which incorporates a motion sensor such as shown in FIG. 4.

Referring now to FIG. 6, there is shown detailed circuitry for a system such as shown in the block diagram of FIG. 2. As is shown, standard AC power is provided to charging circuitry 20. Charging circuitry 20 includes a capacitor 90 for limiting the amount of current flowing from the ac line through rectifier 92 and 94. Resistor 95 is for purposes of preventing any charge which might accumulate on capacitor 90 from being reflected into the AC system causing electric shock at the plug. Thus, it will be appreciated that the output of charging circuitry 20 may then be applied to the rechargeable power source 22 which typically will be a battery. The output of rechargeable power source 22 is then provided through key switch 42. In addition, monitoring circuit 26 is provided for purposes of determining whether or not power is available from charging circuit 20 to recharge power source 22 when necessary. Monitoring circuitry 26 includes resistor 96 and capacitor 98 which serve to filter the rectified, yet pulsating voltage, provided by charging circuit 20. The filtered voltage is then applied to current limiting resistor 100 prior to being applied to the base of transistor 102. Transistor 102 is shown in this embodiment as being a PNP type high beta transistor. Thus, it will be appreciated by those skilled in the art, that by maintaining a voltage on the base of transistor 102, the transistor remains saturated so that its collector to emitter voltage remains low.

Once primary power is removed from the circuitry, however, the collector to emitter voltage across transistor 102 is allowed to increase substantially, and such increased voltage would then be applied to oscillator circuitry 34 which as is shown in FIG. 6 as a multivibrator. Thus, in operation it will be appreciated that when the circuitry 20 is providing a charging voltage to rechargeable power source 22, the voltage applied from the collector of transistor 102 to the base of transistor 104 is too low to allow transistor 104 to conduct. However, as the voltage across transistor 102 increases, this increased voltage must be dropped across resistor 105. The voltage drop across resistor 105 results in sufficient voltage difference between the base and emitter of transistor 104 to turn it on. Therefore, it will be appreciated that when the circuitry is first turned on, capacitors 106 and 108 will initially charge. However, after these capacitors have charged, there will be no current flow through resistor 110 (with respect to transistor 112) or through resistors 114, 116, or 118 with respect to transistor 104. Thus, no gate voltage is applied to SCR 36 in the combination switch and alarm means 38. It will be appreciated, however, that a power transistor could be used instead of an SCR. Similarly, of course, there is no current flow in resistor 120 such that transistor 112 also is cut off. Therefore, multivibrator or oscillator 34 which consists of transistors 104 and 112 will remain inoperative even if the motion sensor switch 30 is closed and shorts out capacitor 108. This inoperative state remains so long as transistor 102 in monitoring circuit 26 remains in a saturated state. However, if AC power is disconnected then it will be appreciated as stated heretofore that transistor 102 will no longer be saturated and the collector to the emitter voltage will increase such that the base voltage provided to transistor 104 can increase and the multi-vibrator start operating when and if switch 30 is closed. That is, if switch 30 is closed then capacitor 108 will be discharged. Thus, transistor 104 will start to conduct, and the resulting voltage across resistor 116 will cause SCR 36 to trigger and apply power to horn 40. When transistor 104 is not conducting, SCR 36 will unlatch because of the opening of contacts within the horn 40 itself. This action will continue with the resulting pulsating blast from the horn until AC power is reapplied to the circuitry, key-operated switch 42 is open, or the rechargeable power source 22 is exhausted. Capacitor 122 serves to decouple the horn from the multi-vibrator for more reliable operation.

Figure 7:
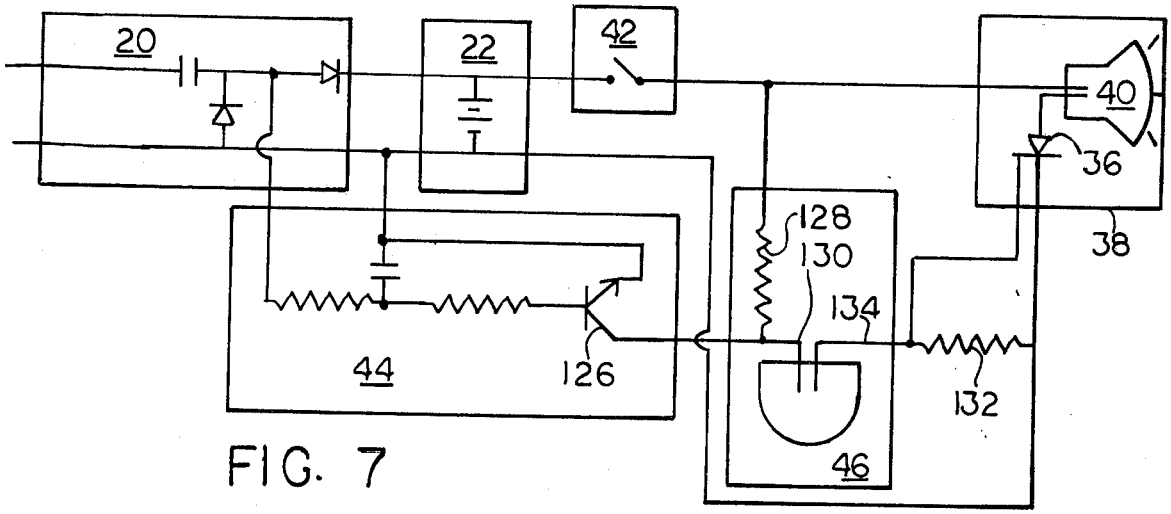
FIG. 7 shows an electrical schematic of an anti-theft device such as disclosed in the block diagram of FIG. 3 and which incorporates a mercury interrupter which operates as both the motion sensor and oscillator of the circuit.

Referring now to FIG. 7, there is shown another embodiment of the present invention which incorporates the use of a mercury interrupter of the types discussed heretofore for purposes of operating as both the oscillator and the motion sensing switch. As shown, this embodiment also uses a charging circuitry 20 and a monitoring circuit 44 as well as a rechargeable power source 22 and a switch 42. As will be appreciated by those skilled in the art, the recharging circuitry 20 and the monitoring circuitry 44 of FIG. 7 operate substantially the same as the charging circuitry 20 and the monitoring circuitry 26 discussed heretofore with respect to FIG. 6. For purposes of illustrating the flexibility of the circuitry that can be used in this invention, the embodiment of FIG. 7 shows a reversed polarity in the rechargeable power source. Consequently, circuit components of monitoring circuitry 20 are also reversed as necessary, as well as a change from a PNP to an NPN transistor. However, the similarity of the circuit operation is readily obvious.

More important, however, the output from the collector of transistor 126 in monitoring circuitry 44 is applied to a mercury interrupter rather than to a multi-vibrator as was done in the circuitry of FIG. 6. Further, as can be seen, there is no motion sensor 30 in this embodiment. Thus, when recharging power is available from circuitry 20 to recharge power source 22, transistor 126 will be in a state of full conduction such that the full voltage potential of power supply 22 must be dropped across resistor 128 with the result that input lead 130 of mercury interrupter circuit 46 is at zero potential. As will be appreciated by those skilled in the art, since SCR 36 is not conducting, the anode of SCR 36, both sides of resistor 132 as well as the other mercury interrupter lead 134 also fall to a zero potential. Thus, even if mercury interrupter 46 is jarred or moved such that a circuit is completed through the interrupter 46, the mercury interrupter will remain inoperative since both input leads 130 and 134 of mercury interrupter 46 are at substantially the same potential. However, if AC power is removed, such that charging circuit 20 can no longer charge power source 22, then transistor 126 will be cut off or stop conducting. In that event, the collector of transistor 126, as well as input lead 130 of mercury interrupter 46 will increase to the full potential of power source 22. Now in the event that mercury interrupter 46 is moved or jarred such that a circuit is completed through leads 130 and 134 of the mercury interrupter 46, it will be appreciated that the full potential of power source 22 will then be proportionally dropped across resistors 128 and 132. Thus, a current flow will be established through mercury interrupter 46 which will put mercury interrupter in an oscillation mode as was discussed heretofore. In addition, the voltage drop across resistor 132 will raise the gate voltage of SCR 36 with respect to the anode voltage such that SCR 36 will also conduct. Consequently, a current will flow through horn 40 thereby causing a pulsating audible alarm. This alarm will continue until AC power is reapplied to the circuitry, the key switch operated such that power is no longer available to the horn, or until power source 22 is exhausted. Thus, it can be seen that a simplified and less expensive circuitry can be provided by the use of a mercury interrupter.

Figure 8:
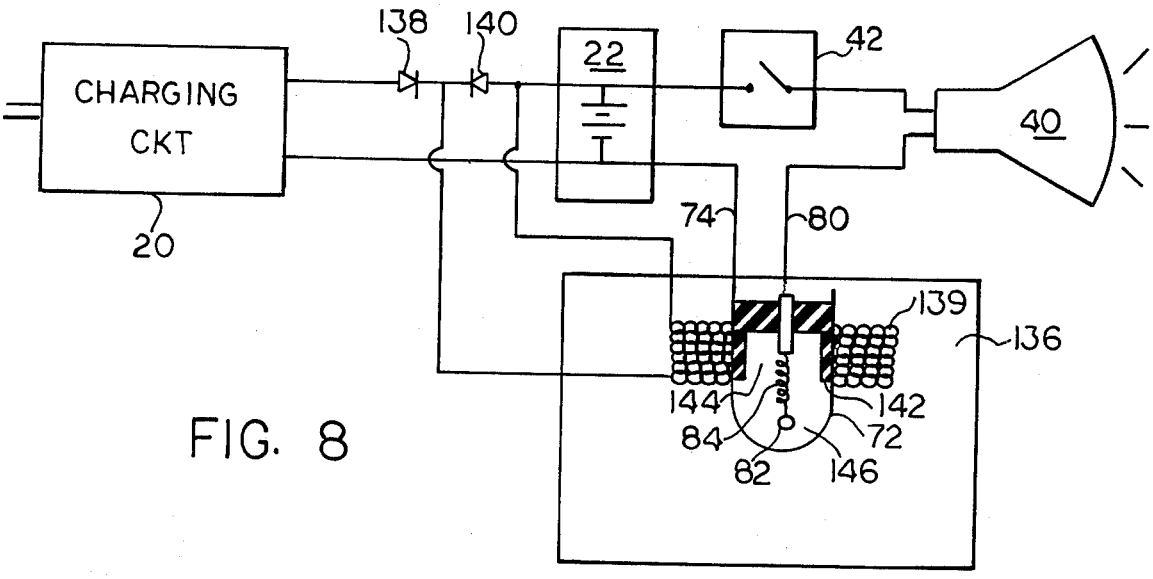
FIG. 8 shows still another embodiment of the present invention which incorporates a modified mercury interrupter and requires a minimum number of components.

Referring now to FIG. 8, there is shown still a simpler device which incorporates the features of this invention, and which allows the elimination of still more circuitry. As in the case of the embodiment discussed heretofore with respect to FIGS. 6 and 7, a charging circuit 20 is used. The charging circuitry 20 also feeds a power source 22 and a switching circuit 42 which in this case will operate simply to open the power source to horn 40. The circuit also includes a modified mercury interrupter circuit 136. Also included are two diodes 138 and 140 which serve as isolation diodes. Thus, it can be seen that when charging circuit 20 is connected to standard AC power, the flow of current is out of charging circuit 20 through diode 138, through solenoid coil 139 and into battery or power source 22. Mercury interrupter circuit 136 shown is similar to a mercury interrupter discussed heretofore with respect to FIG. 5B. However, as is shown, mercury interrupter 136 also includes an insulating cylinder 142 on the inside of the conducting enclosure as well as being surrounded by solenoid 139. In addition, the mercury ball 82 includes a magnetic iron core. Therefore, it can be seen that the current flow through solenoid 139 will serve to retract the mercury-wetted ball 82 up unto the insulated area 144 such that the mercury-wetted metal ball 82 cannot make contact with the conducting enclosure 72. Thus, it will be appreciated that in this condition, mercury interrupter circuit 136 is inoperative and a current flow cannot exist through alarm 40. However, in the event the charging circuit is disconnected from the AC power source, then the current flow through solenoid 139 will cease since the diode 140 will serve to maintain both inputs to solenoid 139 at the same potential. At that time, the mercury-wetted ball 82 will fall into area 146 of the mercury interrupter 136 such that if it is now jarred or moved such that contact between the mercury-wetted ball 82 and conducting enclosure 72 is made, the mercury interrupter initiates the oscillation operation, discussed heretofore, and provides a path for current flow through alarm 40, thereby resulting in a pulsating audible alarm from horn 40. Thus, it will be appreciated that horn 40 will continue to give off an alarm until switch 42 is open, AC power is reconnected, or power source 22 is exhausted.

While there have been described what are at present considered to be preferred embodiments of this invention, it will be obvious to those skilled in the art that various changes and modifications may be made therein without departing from the invention, and it is, therefore, intended to cover all such changes and modifications as fall within the true spirit and scope of the invention.

I claim:

1. Theft detection and prevention circuitry for use with an electrical appliance having means for connecting to a primary electrical power source, which primary electrical power source provides electrical power for operation of said electrical appliance, said anti-theft and protection circuitry comprising:

a rechargeable electrical power source;

charging circuitry connected between said means for connecting of said electrical appliance and said rechargeable electrical power source for receiving power from said primary electrical power source and for providing suitable power for recharging said rechargeable electrical power source;

self-latching oscillation means connected to said rechargeable power source for providing a pulsating signal when activated;

alarm means responsive to said pulsating signal;

switching means responsive to a trigger signal for connecting said pulsating signal to said alarm means;

a motion sensor for determining when said electrical appliance is moved and for providing a motion signal;

monitoring means for determining when said charging circuit is providing suitable power for recharging said rechargeable power source, for determining when said motion signal is present, and for activating said oscillation means and initiating said trigger signal when said motion signal is present at the same time said charging circuitry is not providing suitable power such that said latching means connects said alarm means to said activated oscillation means when said appliance is disconnected from said primary electrical power source and moved.

2. The circuitry of claim 1 wherein said oscillation means is a multi-vibrator circuit and said switching means is a Silicon Controlled Rectifier (SCR), said multi-vibrator, SCR, and said monitoring means being connected such that said multi-vibrator is rendered operable only when said rechargeable power source is not being provided with suitable power for recharging and such that said motion signal from said motion sensor initiates oscillation of said multi-vibrator circuitry, said trigger signal to said SCR being provided by voltage oscillation of said multi-vibrator circuit, and said SCR being connected between said rechargeable power source and said alarm means.

3. The circuitry of claim 1 wherein a mercury interrupter operates both as said oscillation circuit and said motion sensor and said latching circuit is a SCR, said mercury interrupter, said SCR and said monitoring circuit connected such that said mercury interrupter is rendered operable only when said rechargeable power source is not being provided with suitable power for recharging said rechargeable power source, and such that oscillation of said mercury interrupter provides said trigger signal to said SCR, and said SCR being connected between said rechargeable power source and said alarm means.

4. The circuitry of claims 1, 2 or 3 wherein said primary electrical power source is standard AC power.

5. The circuitry of claims 1, 2 or 3 wherein said alarm means provides an audible alarm.

6. The circuitry of claims 1, 2, or 3 and further including a power switch for selectively inhibiting the operation of said circuitry.

7. The circuitry of claim 6 wherein at least one circuit component selected from said motion sensor, said latching circuit and said alarm means operates on power received from said rechargeable electrical power source, and wherein said power switch is connected between said rechargeable electrical power source and said at least one circuit component such that operation of said at least one circuit component may selectively be inhibited by interrupting power to said at least one selected circuit component by operation of said power switch.

8. The circuitry of claim 6 wherein said power switch is a key-operated switch.

9. Theft detection and prevention circuitry for use with an electrical appliance, which appliance includes means for connecting to standard AC electrical power and which operates on said AC electrical power comprising:

a rechargeable electrical DC power source;

charging circuitry connected between said means for connecting of said electrical appliance and said rechargeable electrical DC power source for receiving said standard AC power from said primary electrical power source and for providing suitable DC power for recharging said rechargeable DC electrical power source;

a mercury interrupter connected to said rechargeable power source, which mercury interrupter may be activated when said electrical appliance is moved and for providing a pulsating trigger signal;

alarm means;

an SCR switch connected between said rechargeable power source and said alarm means said SCR being responsive to said trigger signal for intermittently connecting said rechargeable power source to said alarm means; and monitoring means for determining when said charging circuitry is providing suitable power for recharging said rechargeable power source and for rendering inoperative said mercury interrupter when said charging circuitry is not providing suitable power such that said SCR intermittently connects said alarm means to said rechargeable power source when said appliance is disconnected from said primary AC electrical power source and moved.

10. Theft detection and prevention circuitry for use with an electrical appliance, which appliance includes means for connecting to standard AC electrical power and which operates on said AC electrical power comprising:

a rechargeable electrical DC power source;

charging circuitry connected between said means for connecting of said electrical appliance and said rechargeable DC power source for receiving said standard AC power from said primary electrical power sources and for providing suitable DC power for recharging said rechargeable DC electrical power source;

alarm means;

a mercury interrupter connected to said rechargeable power source and said alarm means, and being suitable for providing intermittent power to said alarm;

a solenoid surrounding said mercury interrupter for rendering said mercury interrupter inoperative when energized; and means connected between said charging circuit and said rechargeable power source for providing a current flow through said solenoid when said charging circuit is providing power to said power source, and for preventing said current flow when no power is being provided from said charging circuit to said power source.

11. The circuitry of claims 1, 2, 3, 9 or 10 wherein said rechargeable electrical power source is a recharging battery pack.

* * * * *